US006482131B2

(12) United States Patent
Kuo

(10) Patent No.: US 6,482,131 B2
(45) Date of Patent: Nov. 19, 2002

(54) STEP ADJUSTER OF AN OVAL TRACK WALKER

(75) Inventor: Chun-Chang Kuo, Tainan (TW)

(73) Assignee: Tonic Fitness Technology, Inc., Tainan Hsien (TW)

( * ) Notice: Subject to any disclaimer, the term of this patent is extended or adjusted under 35 U.S.C. 154(b) by 3 days.

(21) Appl. No.: 09/757,237

(22) Filed: Jan. 8, 2001

(65) Prior Publication Data

US 2002/0091042 A1 Jul. 11, 2002

(51) Int. Cl.[7] ..... A63B 69/16; A63B 22/04
(52) U.S. Cl. ..... 482/52; 482/51
(58) Field of Search ..... 482/51, 52, 53, 482/57, 70

(56) References Cited

U.S. PATENT DOCUMENTS 5,433,680 A * 7/1995 Knudsen ..... 482/57
5,690,589 A * 11/1997 Rodgers ..... 482/57
6,248,045 B1 * 6/2001 Stearns et al. ..... 482/52
6,338,698 B1 * 1/2002 Stearns et al. ..... 482/52

* cited by examiner

*Primary Examiner*—Stephen R. Crow
(74) *Attorney, Agent, or Firm*—Pro-Techtor International Services

(57) ABSTRACT

A step adjuster for an elliptical exercise device includes two assembly frames that are each pivotally connected with a sector gear and a movable sector disc for mutual movement. An eccentric portion of the sector gear and the movable sector disc are connected to crank blocks in slide grooves of the assembly frames by means of adjusting arms, and pedal cranks are respectively connected between the crank blocks and pedals. The sector gear has teeth engaging a worm gear of a hand crank, and moves to synchronously adjust the distance between the pedals and the connect rods.

3 Claims, 6 Drawing Sheets

STEP ADJUSTER OF AN OVAL TRACK WALKER

BACKGROUND OF THE INVENTION

This invention relates to a step adjuster for an elliptical exercise device. Elliptical walkers generally conform to a person's natural walking motion, so that a user may feel as comfortable and safe as if walking on a road, and is less likely to injure his joints.

A conventional elliptical walker having a step adjuster is disclosed in the Taiwan Patent Gazette Publication No. 320066 on Nov. 11, 1997. In accordance with the patent, the method of adjusting the step is to provide a plurality of holes 26 in a vertaical line in an extending arm 25 for a pivotal pin 28 to fit therein to adjust the pivotal rod 27 to different distances, and synchronously adjust the moving distance of the pedals 24 on the drive rods 20.

However, the conventional device is inconvenient to use due to the time and effort required to pull out the pin and then reinsert it in the proper hole to adjust the step distance. Besides, the adjustment of the step depends only on a few fixed holes, and it is impossible to meet various requirements of step adjustment. Moreover, in use, two pedals must be adjusted individually, and at the same time two pivotal pins have to be adjusted as well, thus adding significant complexity of use.

Another conventional step adjuster is provided with two motors as motive power for adjusting the step. High voltage is generally required to produce the required horsepower. The device therefore tends to generate electromagnetic wave that interfere with the signal controlled by low voltage.

SUMMARY OF THE INVENTION

The objective of the present invention is to offer a step adjuster for an elliptical exercise device that does not need an expensive electric motor for controlling step adjustment so that the cost of the device is reduced. The device is convenient to use due to synchronous adjustment of the two pedals.

BRIEF DESCRIPTION OF THE DRAWINGS

This invention will be better understood by referring to the accompanying drawings, wherein.

DETAILED DESCRIPTION OF THE PREFERRED EMBODIMENT

Figure 3:
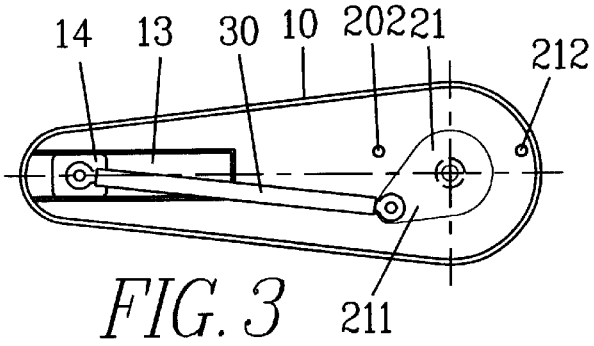
FIG. 3 is a cross-sectional view of the step adjuster, taken from the direction marked by 3 in FIG. 1.
Figure 1:
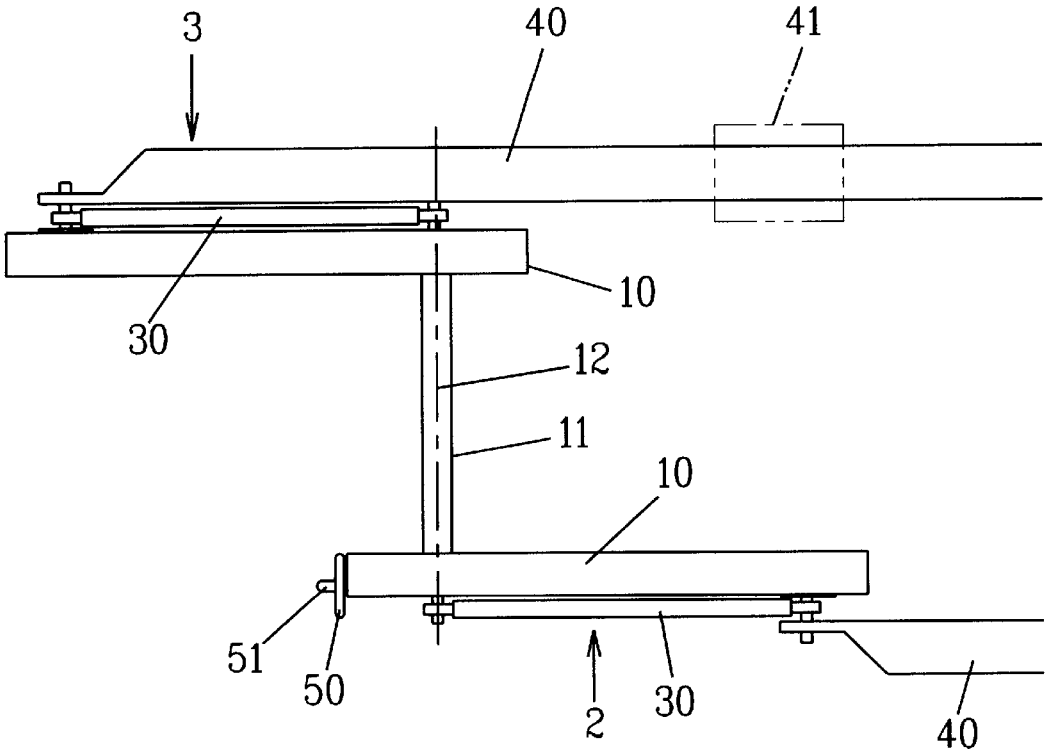
FIG. 1 is a top view of a step adjuster for an elliptical exercise device of the present invention.
Figure 2:
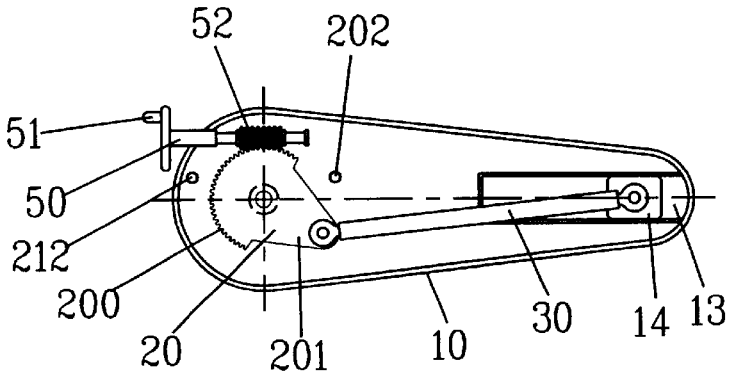
FIG. 2 is a cross-sectional view of the step adjuster, taken from the direction marked by 2 in FIG. 1.
Figure 1B:
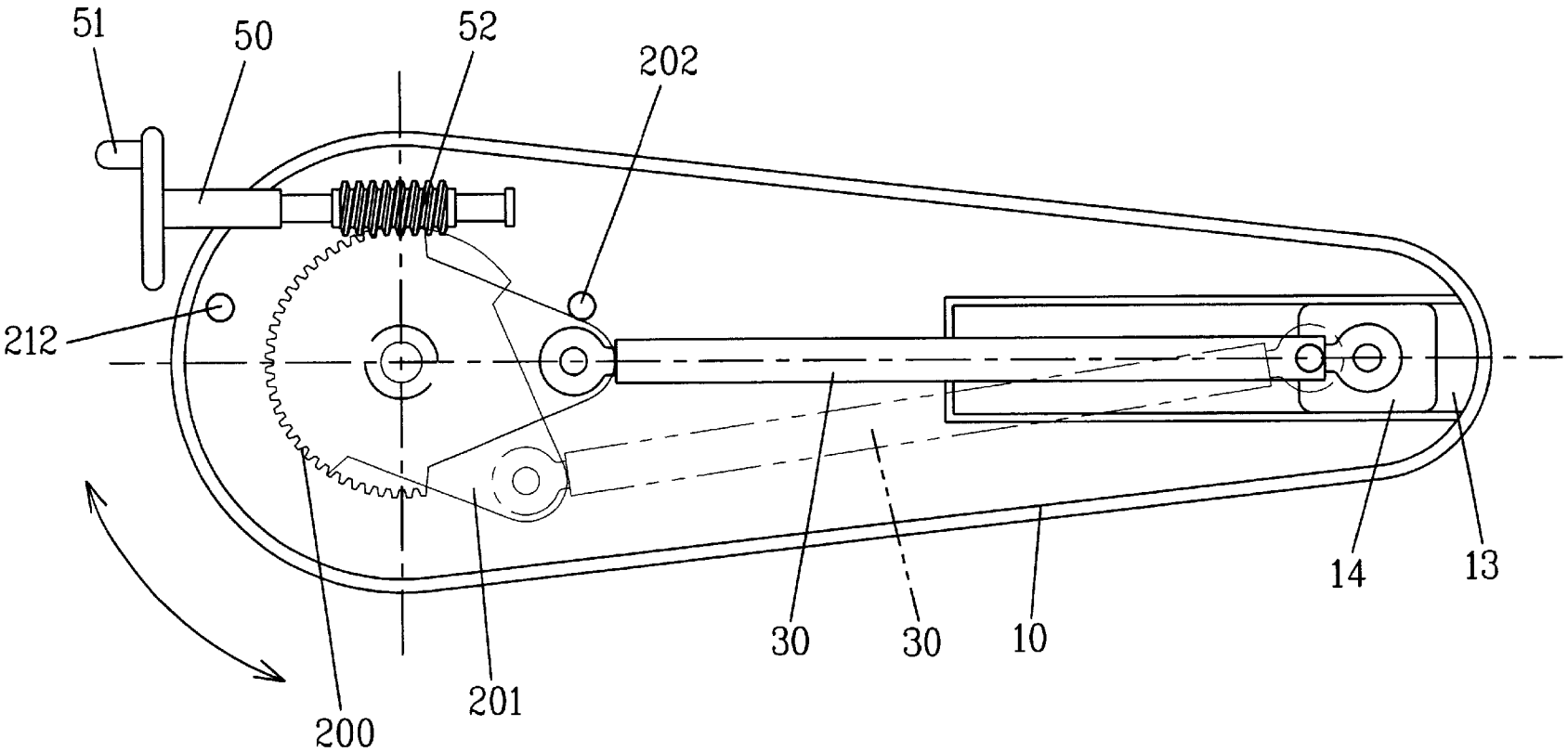
FIG. 1B is an enlarged view of FIG. 2.

An embodiment of a step adjuster for the elliptical exercise device of the present invention, as shown in FIG. 1, includes two parallel assembly frames 10. An inner end portion of a first assembly frame 10 faces an outer end portion of a second assembly frame 10. Between the inner end portion of the first assembly frame and the outer end portion of the second assembly frame is a hollow tube 11 with a connecting rod 12 fixed in the hollow tube 11. Both ends of the connecting rod 12 extend out of the assembly frames 10 to connect with a sector gear 20 and a movable sector disc 21. Each assembly frame 10 has a horizontal slide groove 13 spaced from the end of the connect rod 12. The slide groove 13 receives a crank block 14. The crank block 14 is movably installed in the slide groove 13.

The sector gear 20 and the movable sector disc 21 are fixed at opposite ends of the connecting rod 12. Teeth 200 of the sector gear 20 have a preset length to engage a worm gear 52 of a hand crank 51.

Two adjusting arms 30 are pivotally connected between the eccentric portions 201, 211 of the sector gear 20 and the sector disc 21 and the crank blocks 14. On an upper side of each assembly frame 10, near the edge of the sector gear 20 and the movable sector disc 21 are provided two projecting stop members 202, 212 to set a limit for rotation of the sector gear 20 and the movable sector disc 21.

Two pedal cranks 40 are provided to pivotally connect with the assembly frames 10, with one end pivotally connected to the crank block 14, and the other end extending outward to connect with pedals 41.

In addition, the drive wheel 50 of the hand cranks 51 abutting the sector gear has a worm gear 52 at a distal end to engage the teeth 200 of the sector gear 20.

Figures 4, 4A:
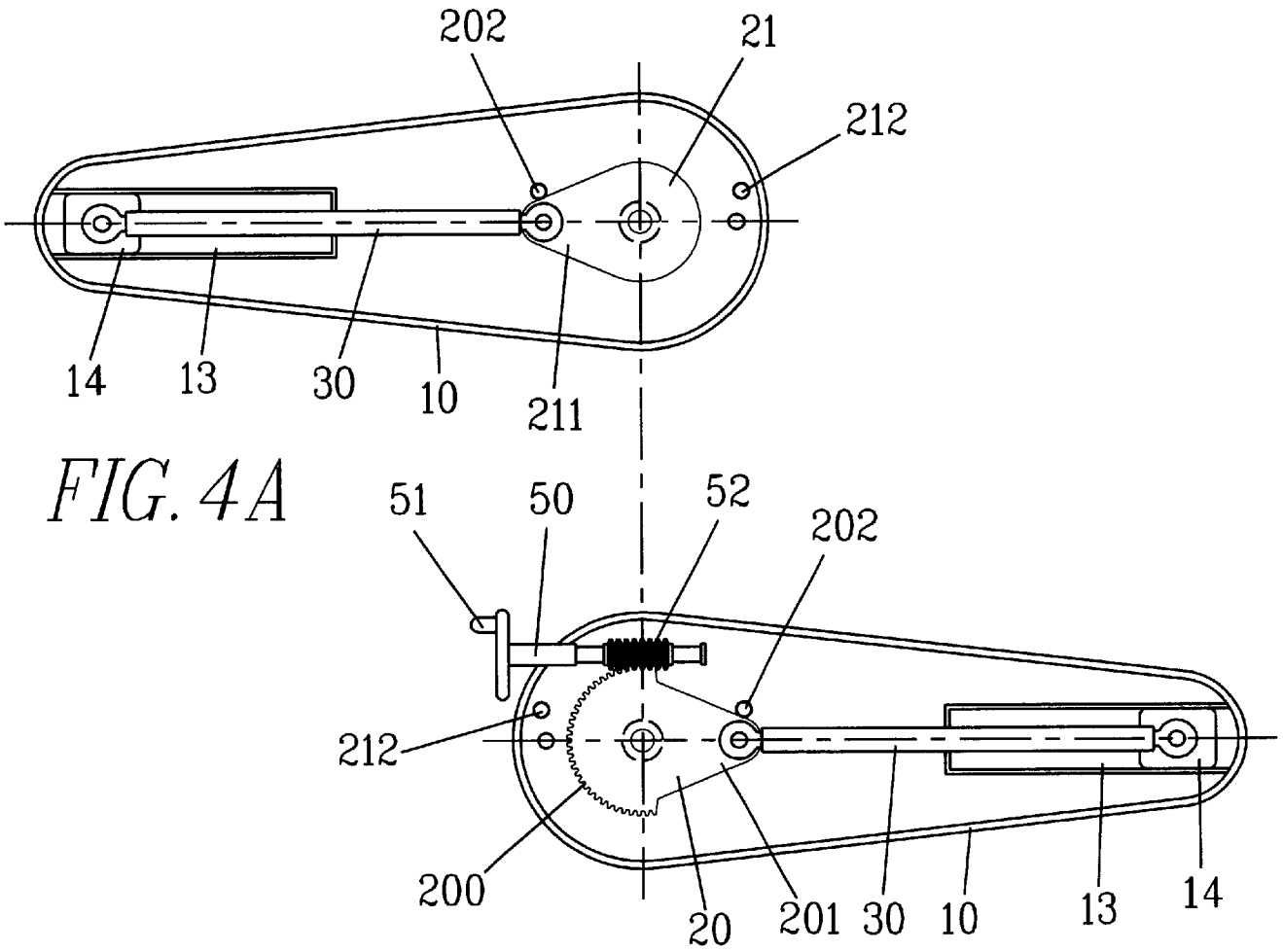
FIGS. 4 and 4A show a cross-sectional view of the step adjuster adjusted to the maximum position.
Figures 5, 5A:
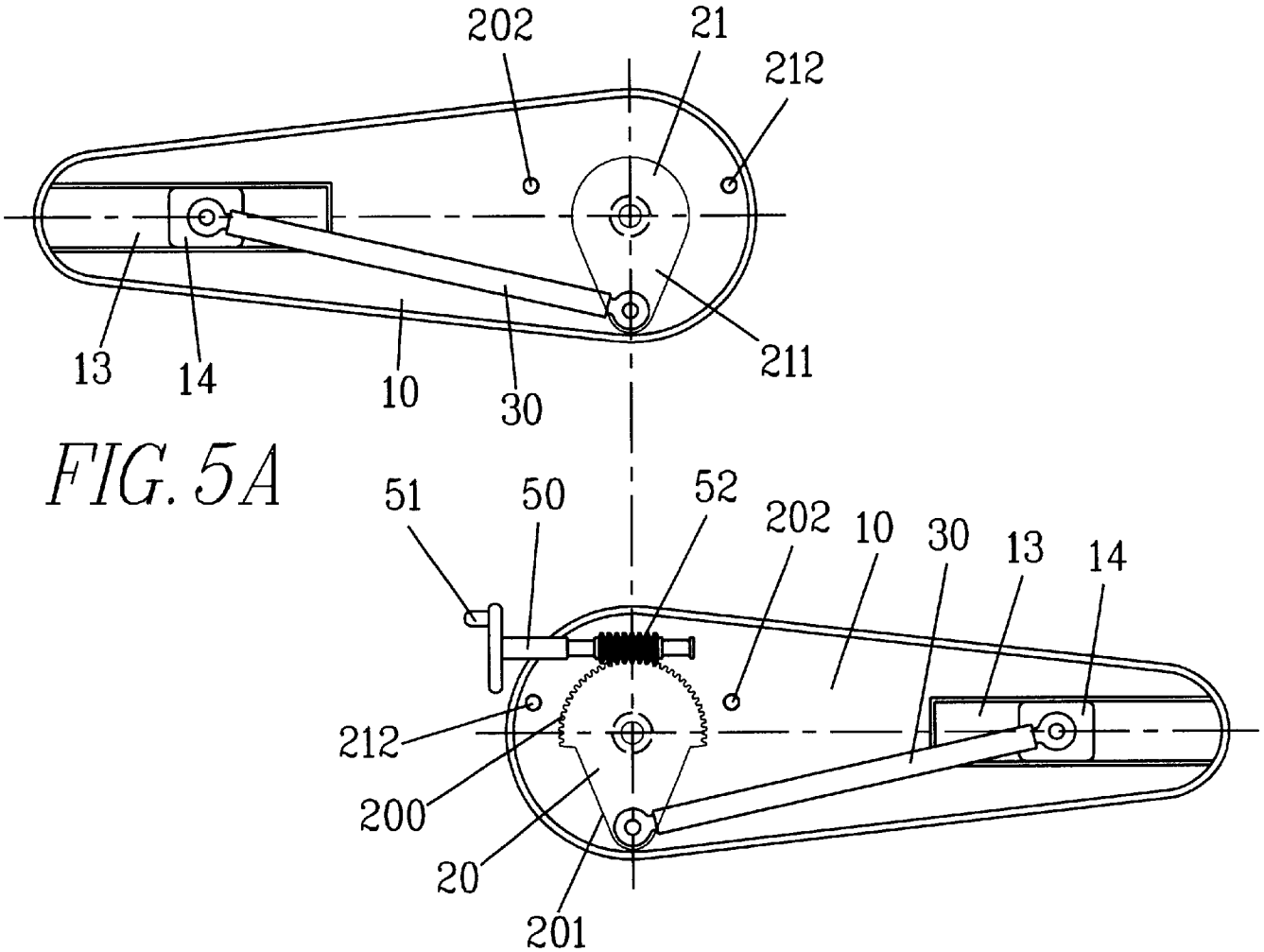
FIGS. 5 and 5A show a cross-sectional view of the step adjuster, with the step adjusted to a medium position.
Figures 6, 6A:
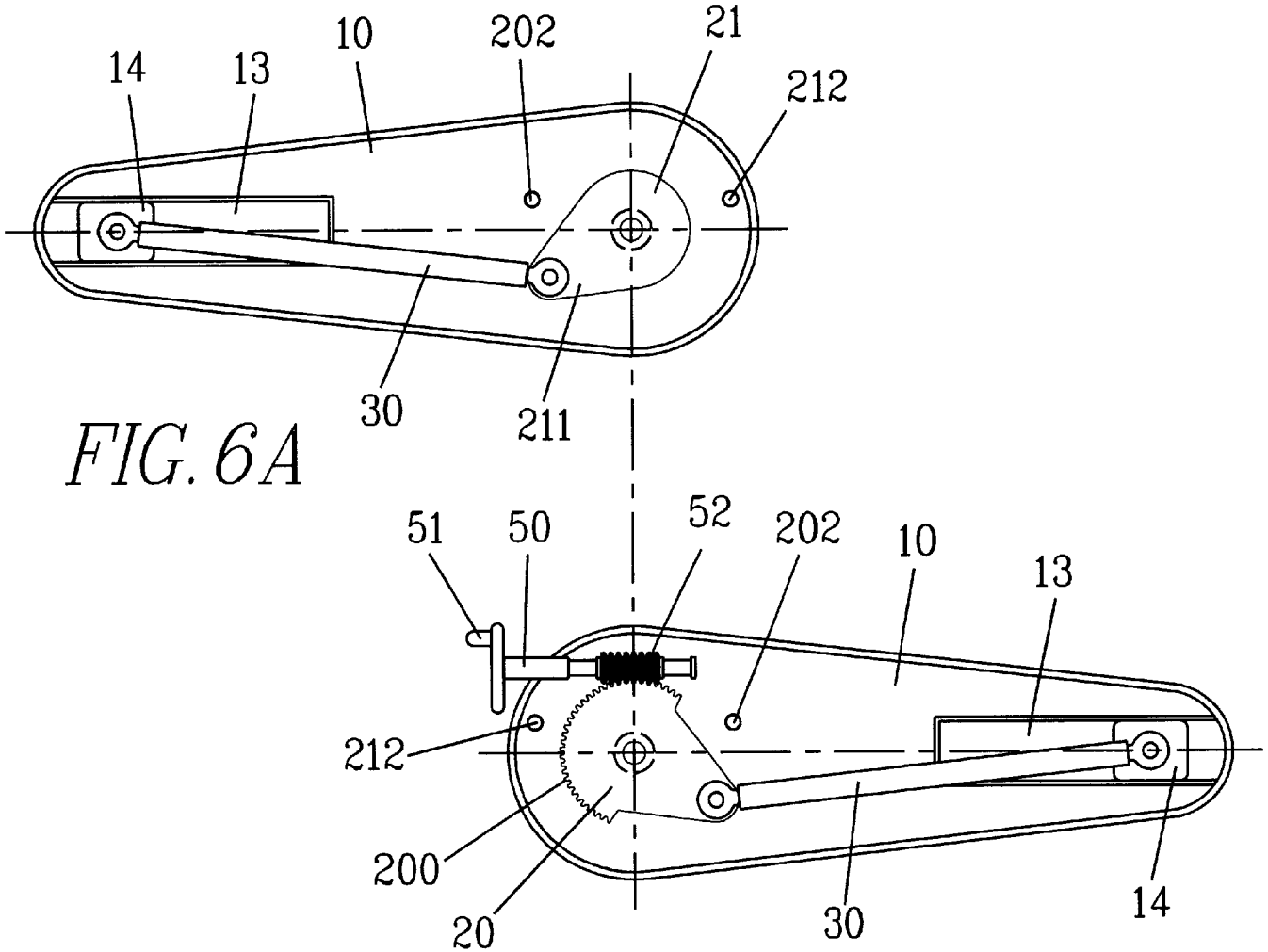
FIGS. 6 and 6A show a cross-sectional view of the step adjuster adjusted to another intermediate position.

After assembly, the operation of the step adjuster is as follows:

1. To maximize a step, as shown in FIGS. 4 and 4A, turn the hand crank 51 to drive the sector gear 20 to rotate to make the adjusting rod 30 move to a horizontal position (zero degrees). This allows the crank block 14 to move farther away from the sector gear 20. The sector gear 20 touches stop member 202 and stops, thus defining the longest stroke between the pedals 41 and the connecting rod 12 for the maximum step.

As they are connected by the connecting rod 12, the sector gear 20 and the movable sector disc 21 move together to synchronously adjust the two adjusting rods 30, the two pedal cranks 40 and the two pedals 41.

2. To shorten the step, as shown in FIGS. 5 and 5A and 6 and 6A, turn the hand crank 51 to rotate the sector gear 20, which causes the adjusting rod 30 to pull the crank block 14 toward the sector gear 20 so as to adjust the distance between the pedals 41 on the pedal cranks 40 and the connecting rod 12.

Figures 7, 7A:
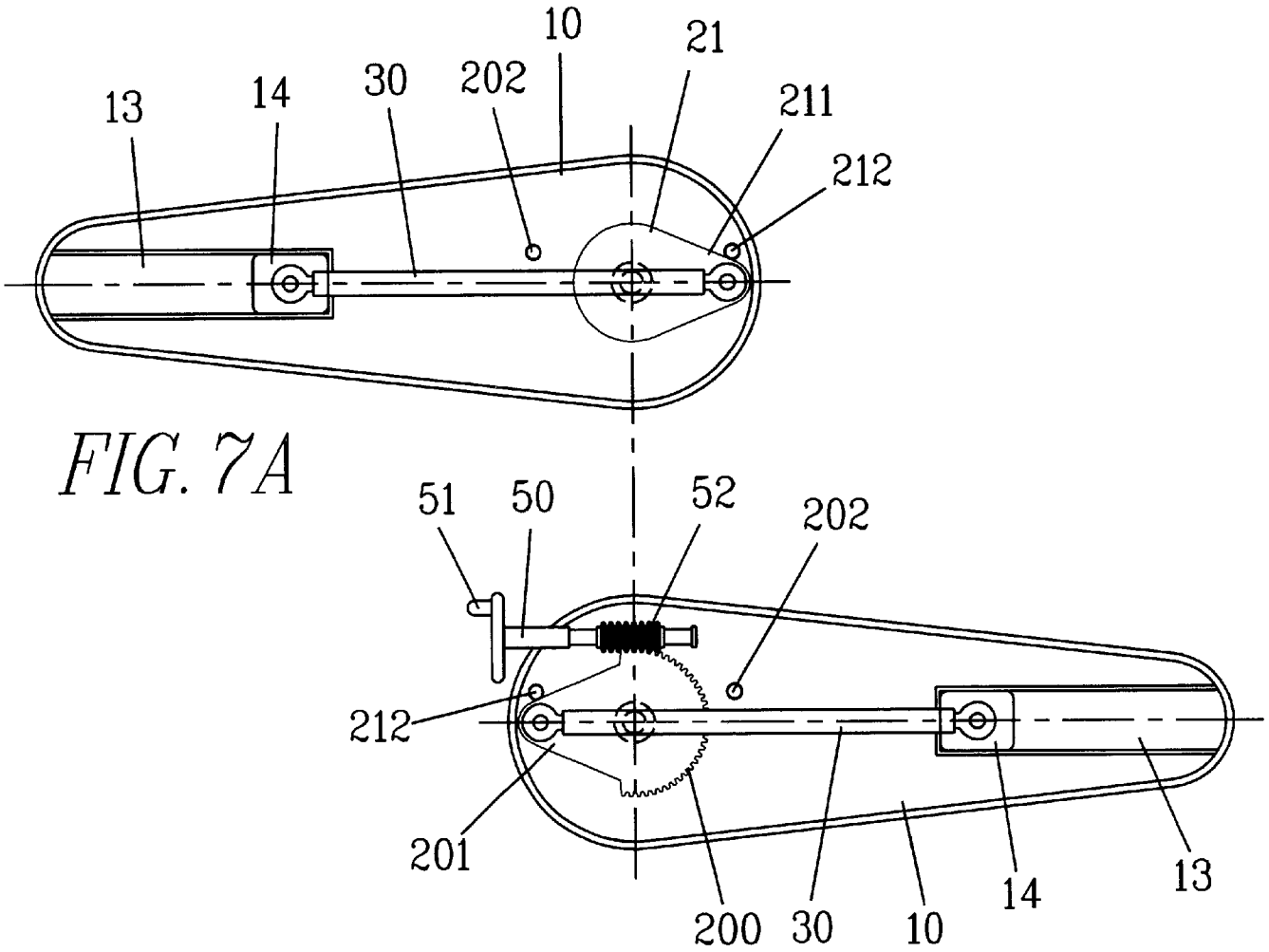
FIGS. 7 and 7A show a cross-sectional view of the step adjuster adjusted to the minimum position.

3. To minimize the step, as shown in FIGS. 7 and 7A, turn the hand crank 51 to drive the sector gear 20 to a forward most position of (180 degrees), causing the crank blocks 14 to move as close as possible to the sector gear 20, thereby defining a shortest distance between the pedals 41 and the connecting rod 12. The eccentric portions 201, 211 contact the other projecting stop members 212 and stop.

As can be understood from the above description, the invention has the following advantages:

1. The cost is minimized, and it is easy and convenient to handle the step adjuster.
2. There are wide ranges for step adjustment.
3. The step between two pedals can be adjusted synchronously, saving a good deal of time.

While the preferred embodiment of the invention has been described above, it will be recognized and understood that various modifications may be made therein, and the appended claims are intended to cover all such modifications that may fall within the spirit and scope of the invention.

I claim:

1. A step adjuster for an elliptical exercise device comprising:

a first assembly frame and a second assembly frame, a rear portion of said first said assembly frame aligning with a front portion of said second assembly frame, a hollow tube provided between said rear portion of said first assembly frame and said front portion of said second assembly frame, said hollow tube contains therein a connect rod, two ends of said connect rod extend through said hollow tube and out of said assembly frames, a horizontal slide groove provided at an end of each said assembly frame distal from said connect rod, each said slide groove containing therein a crank block, said crank block moving back and forth in said slide groove, a sector gear connected to a first end of said connect rod and a movable sector disc connected to a second end of said connect rod, an outer edge of said sector gear comprising a plurality of teeth, two adjusting arms, first ends of said adjusting arms being pivotally connected to an eccentric portion of said sector gear and an eccentric portion said sector disc respectively, and second ends of said adjusting arms being connected to a corresponding one of said crank blocks, two pedal cranks, each said pedal crank includes a first end pivotally connected to one of said crank blocks and a second end connected to one of said pedals, and a hand crank contacting said sector gear, an inner end of said hand crank comprising a worm gear that engages said teeth of said sector gear; wherein said hand crank is turned to drive said sector gear which in turn rotates to a proper angle to adjust a distance between said crank block and said connect rod, thereby adjusting a step length between said two pedals.

2. The step adjuster for the elliptical exercise device of claim 1 wherein:

stop members are provided on said assembly frame, said stop members contact said sector gear and said sector disc to define arcs through which said sector gear and said sector disc move.

3. The step adjuster for the elliptical exercise device of claim 1 wherein:

an outer end of said hand crank is provided with an eccentric rotatable handle to drive said worm gear.

* * * * *